United States Patent [19]

Taguchi

[11] 4,148,291

[45] Apr. 10, 1979

[54] RECOIL-TYPE STARTER FOR INTERNAL COMBUSTION ENGINE

[75] Inventor: Michihiro Taguchi, Hamamatsu, Japan

[73] Assignee: Yamaha Hatsudoki Kabushiki Kaisha, Iwata, Japan

[21] Appl. No.: 834,280

[22] Filed: Sep. 19, 1977

[30] Foreign Application Priority Data

Sep. 30, 1976 [JP] Japan ..... 51-131754[U]

[51] Int. Cl.[2] ..... F02N 3/02

[52] U.S. Cl. ..... 123/185 B; 74/6; 74/577 S; 192/42

[58] Field of Search ..... 123/179 SE, 185 A, 185 B, 123/185 BA, 185 BB; 74/6, 577 S; 81/61; 192/42, 46

[56] References Cited

U.S. PATENT DOCUMENTS

| | | | |
|---|---|---|---|
| 2,926,648 | 3/1960 | Hamman | 123/179 |
| 3,127,884 | 4/1964 | Rice | 123/185 |
| 3,366,099 | 1/1968 | Kaufman | 123/185 |
| 3,375,814 | 4/1968 | Hamman | 123/185 |
| 3,730,162 | 5/1973 | Murase | 123/185 BA |
| 3,782,355 | 1/1974 | Hamman | 123/185 B |
| 3,782,356 | 1/1974 | Hamman | 123/185 C |

*Primary Examiner*—Allan D. Herrmann
*Attorney, Agent, or Firm*—Donald D. Mon

[57] ABSTRACT

A recoil-type starter for an internal combustion engine. The starter includes a drum with a starting wire wound around it. The drum is disposed to confront a driven member such as a fly-wheel which is in turn operably connected to the engine. A starting pawl is pivotally secured to a peripheral portion of the drum, and is adapted to be pivotally moved to project radially outwardly of the drum into engagement with a cooperative projection formed on the driven member as the drum is rotated by pulling the starting wire, thereby to impart a starting inertia to the engine through the driven member. A stop is unitarily formed on the drum for limiting the outward pivotal movement of the starting pawl. The stop is positioned to abut a portion of the starting pawl close to the outer end of the latter at which the cooperating projection of the driven member contacts from the radially outer side of the drum. The radial component of the reactional force exerted by the projection on the starting pawl is received and supported by the stop, so that the starting pawl is free of bending force. It can withstand extended use without fatigue breakage.

8 Claims, 5 Drawing Figures

RECOIL-TYPE STARTER FOR INTERNAL COMBUSTION ENGINE

The present invention relates to a recoil starter for starting an engine by pulling a starting wire wound around a drum mechanically associated with the engine.

Recoil starters have been well known and practically used for starting small-output internal combustion engines. These known recoil starters incorporate a drum around which is wound a starting wire, as will be detailed later. The drum pivotally carries a starting pawl adapted for engaging a projection formed on the periphery of a fly-wheel of the engine, so as to cause a rotation of the fly-wheel when the drum is rotated as the wire is pulled. Consequently, the starting pawl is subjected to a large bending force or moment around its pivot axis, in addition to the compression force which acts along its longitudinal axis. This large bending force is apt to break or damage the pawl, as a result of the fatique of the material constituting the pawl caused by the repeated use of the starter, and shortens the life of the starter.

It is therefore an object of the invention to provide an improved starter for an engine in which the bending force applied to the starting pawl is sufficiently reduced to prevent the pawl from being broken by the fatique of the material, thereby to improve the durability of the starter.

To this end, according to the invention, there is provided a recoil starter of the kind described, characterized by comprising a stop provided on the drum for limiting the pivotal movement of the starting pawl, when the latter engages at its outer end a cooperating projection on a driven member, the stop being adapted to abut the starting pawl at a portion of the latter close to the outer end thereof from the radially outer side of the drum.

The above and other objects, as well as advantageous features of the invention will become more clear from the following description of the preferred embodiment taken in conjunction with the attached drawings in which.

Before turning to the description of the embodiments, the drawback of the conventional recoil starter will be fully explained with reference to FIG. 1, for clarifying the technical subject to be achieved by the present invention.

Figure 1:
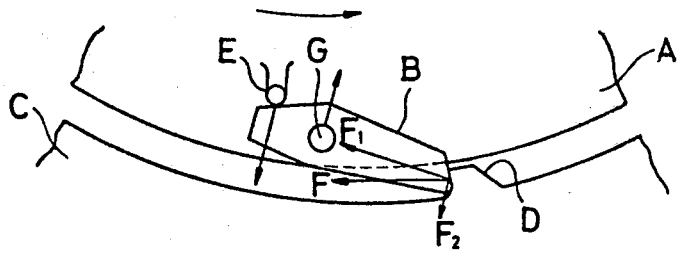
FIG. 1 PRIOR ART
FIG. 1 is a schematic illustration of a conventional recoil starter and shows various forces applied to a starting pawl incorporated in the starter.
Figure 4:
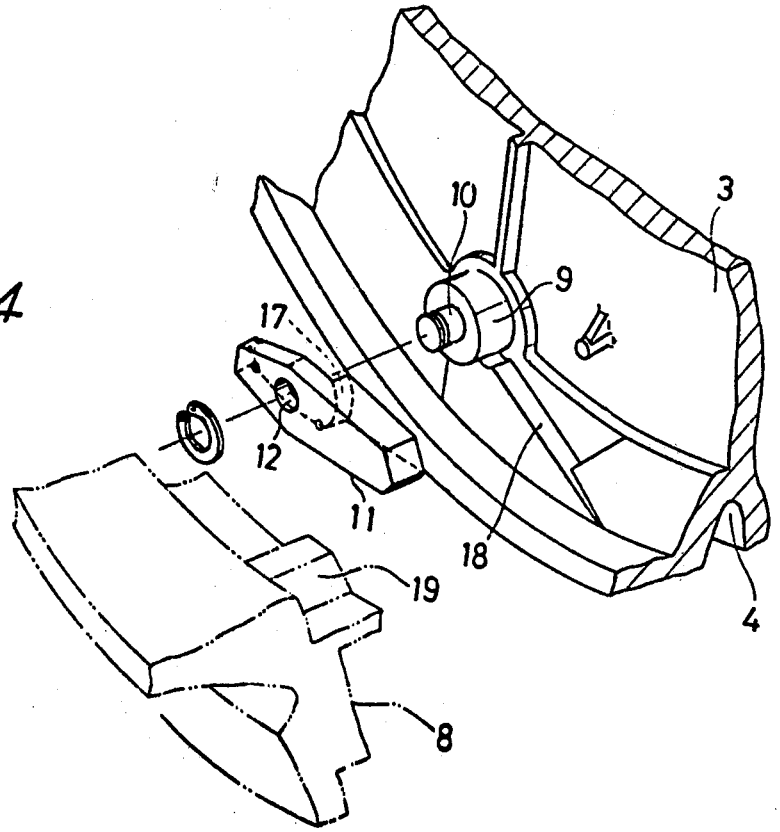
FIG. 4 is a perspective view of an essential part of the starter as shown in FIG. 2.

FIG. 1 shows a typical conventional recoil starter. The starter has a drum A around which a starting wire is wound. Drum A is provided with a starting pawl B pivotally secured thereto. Pawl B is adapted to be pivoted outwardly, at the time of starting, i.e. when the wire is pulled to rotate the drum A, into engagement with a projection D formed on the periphery of a fly-wheel of the engine, so as to impart a starting inertia to the latter. The outward pivotal movement of the starting pawl B is limited by a stop E which engages the base portion of the pawl B.

In the recoil starter having above described construction, due to a radial misalignment of the pivot axis G of the pawl and the end of the pawl at which it contacts the projection D, the tangential reactional force F is decomposed into a compression force F1 which acts in the longitudinal direction of the pawl B toward the pivotal axis G and a component F2 acting in the direction at right angle to the compression force. This component F2 is considerably large and causes a bending moment in the pawl B around the pivot axis G.

Consequently, the pawl B is apt to be broken along a longitudinal or breadthwise line which passes the pivot axis G, due to fatigue of the material caused by the repeated use of the starter.

This problem of poor durability of the starter is, however, fairly overcome by the present invention, in which the stress caused by the bending component F2 is conveniently reduced to prevent the pawl from being broken, as will be seen from the following description of the preferred embodiment.

Referring to FIGS. 2 to 5 inclusive which show the preferred embodiment of the invention, a casing 1 of a starter embodying the invention has at its mid portion a stationary or fixed shaft 2 around which a drum 3 is rotatably fitted. Drum 3 has a peripheral groove 4 receiving turns of a starting wire 5, one end of which leads to the outside of the casing and is connected to a starter handle 6. Drum 3 is normally biased in the clockwise direction as viewed in FIG. 2, by means of a coiled spring 7, so as to retract the starting wire 5 around the drum 3. It will be seen that the drum 3 is rotated counter-clockwise as viewed in FIG. 2, as the wire is unwound by pulling the starter handle 6, at the time of starting.

Casing 1 is secured to the engine (not shown), while drum 3 is disposed in the vicinity of a driven member connected to the crank shaft of the engine, e.g. a fly-wheel 8, coaxially and in side-by-side relation with the latter. A boss 9 is formed on the peripheral portion of the drum 3, at one side of the latter confronting the fly-wheel 8. A pivot shaft 10 is provided on the boss 9. A starting pawl 11 has a bore 12 which receives the pivot shaft 10. In other words, the starting pawl 11 is pivotably supported by the pivot shaft 10.

The fixed shaft 2 has at one end a peripheral frictional groove 13 which slidably receives a substantially U-shaped friction wire 14 having both ends connected to respective ends of starting pawl 11 through links 15, 15. Loops 16 are formed on both ends of the friction wire 14 and at intermediate portions of the links 15, 15, so as to exert resilient force to bias the friction wire deep into the friction groove 13, thereby to ensure a predetermined friction between the wire 14 and the surface of the groove 13.

Starting pawl 11 is made of a plastic having a large impact strength, e.g. polyacetal and is stepped as at 17 to have a thickened portion projecting toward drum 3.

Step 17 is formed to an arcuate shape, for fitting around the periphery of boss 9 formed on the drum 3. Preferably, step 17 is brought into close fitting to the periphery of boss 9, when the aforementioned bore 12 is put into close contact with pivot shaft 10 by a load applied to starting pawl 11.

However, as a matter of fact, it is quite difficult to obtain such a dimensional relationship mainly for the reason of precision of the processing. Therefore, practically, the arrangement is such that the gap between step 17 and the periphery of boss 9 is made smaller than that between bore 12 and pivot shaft 10, in order to ensure a close contact of the periphery of the boss 9 with the step 17 which has a sufficiently large pressure-receiving area.

At the side of drum 3 confronting fly-wheel 8 and in the vicinity of boss 9, a step is formed constituting a stop 18 for the starting pawl. Stop 18 is so designed and positioned that it may abut a portion of the starting claw near the outer end of the latter from the radially outer side of the drum, when the starting pawl is pivoted to project radially outwardly, thereby to limit the pivotal movement of the starting pawl.

Fly-wheel 8 has a projection 19 adapted to be engaged by starting pawl 11 when the latter is pivoted radially outwardly, at the time of the starting.

Figure 2:
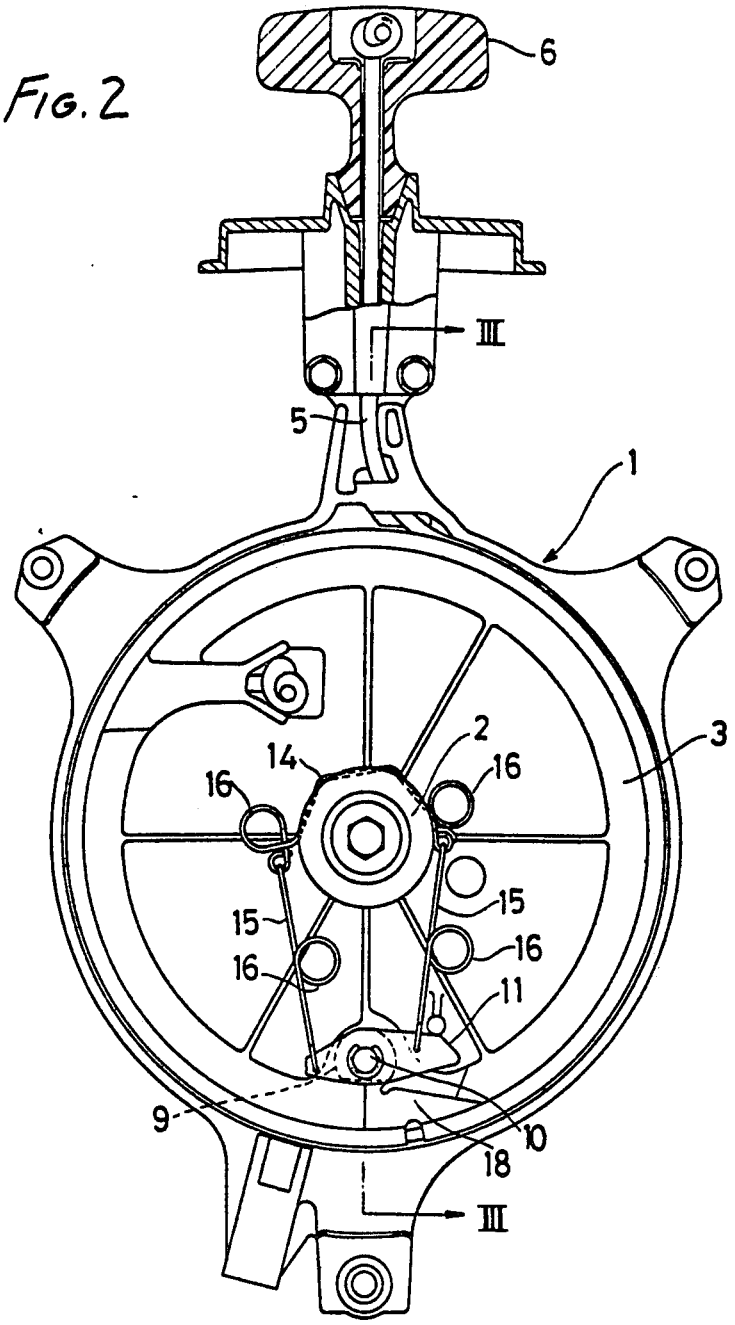
FIG. 2 is a front elevation view of a starter embodying the present invention.
Figure 3:
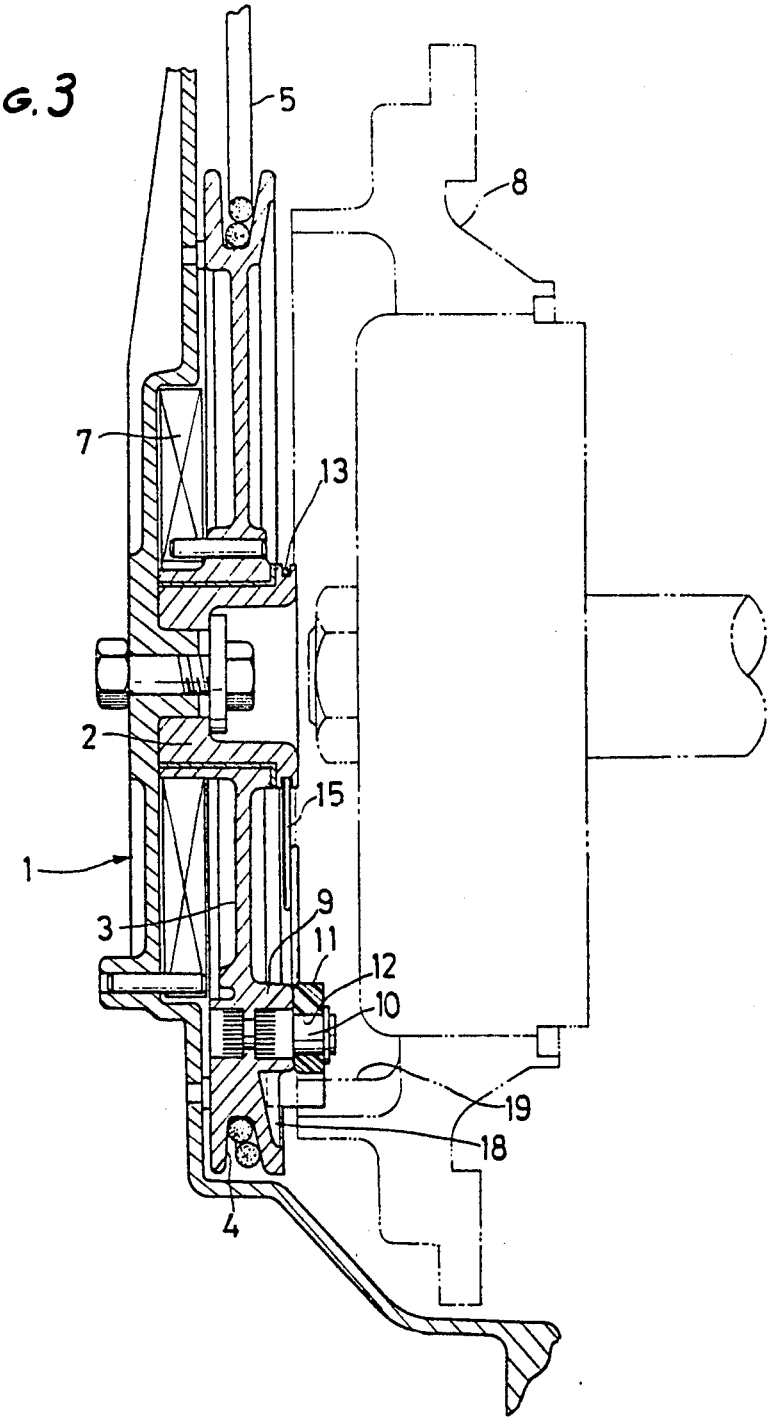
FIG. 3 is a sectional view taken along the line III—III of FIG. 2.

In operation, as the wire 5 is unwound by pulling the starting handle 6, the drum 3 is rotated counter-clockwise as viewed in FIG. 2, along with friction wire 14 connected to starting pawl 11. However, due to the frictional engagement between friction groove 13 and friction wire 14, the latter is displaced slightly in the circumferential direction relatively to drum 3, so as to cause a radially outward pivotal movement of the starting pawl through links 15,15. Consequently starting pawl 11 is brought into contact with projection 19 of fly-wheel 8, so as to transmit the torque to the latter, thereby to start the engine.

Figure 5:
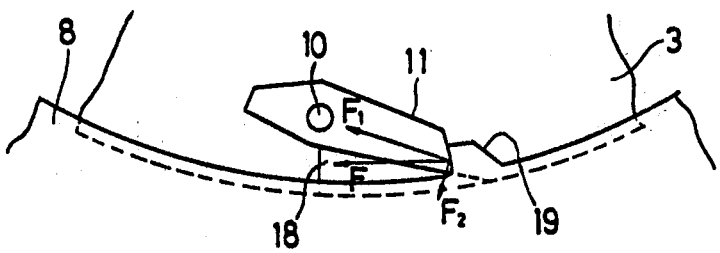
FIG. 5 is an illustration explanatory of forces applied to the starting pawlincorporated in the will of FIG. 2.

At this moment, as will be seen from FIG. 5, a circumferential or tangential force F is exerted by projection 19 on the end of starting pawl 11. This force F is decomposed into a compressive component F1 which acts along the longitudinal axis and a radial component F2 which acts to cause the rotation of starting pawl 11. However, the radial component F2 of the force F is conveniently carried by the stop 18 which projects from the radially outer side of drum 3 in the vicinity of the outer projecting end of starting pawl 11, so that only the compression force F1 and a small radial compression force at the extreme end are applied to starting pawl 11.

Consequently, no substantial bending stress is caused in starting pawl 11 by the bending force F2, so that pawl 11 is freed from the problem of breakage attributable to the fatigue of the material, and is rendered highly durable.

In addition, the concentration of stress around bore 12 is conveniently avoided, because the area of step 17 is large enough to receive the compression force F1, so as to further improve the durability of the starter as a whole.

Since starting pawl 11 is made of a plastic, it exhibits a large impact strength and produces no noise when it hits projection 19. At the same time, the plastic starting pawl never causes a substantial problem, even when it is broken and jammed between operating members.

After the engine has been started, drum 3 is rotated clockwise as viewed in FIG. 2, due to the biasing force of spring 7, so as to retract starting wire 5, as handle 6 is released. During this clockwise rotation of drum 3, the friction appearing between friction wire 14 and friction groove 13 conveniently causes a reverse pivotal movement of starting pawl 11, so as to retract the latter to the inside of the drum 3.

Having described the invention through a specific embodiment, it is to be submitted here that the described embodiment is not exclusive and various changes and modifications may be imparted thereto.

For instance, the step of the starting pawl can be dispensed with.

At the same time, the starting pawl need not always engage the cooperating projection formed on the fly-wheel but may cooperate with any other suitable member provided on a driven member connected to the crank shaft of the engine.

The pivotal movement of the starting pawl may be caused by any other suitable mechanism than described.

Further, the starting pawl may be made of any suitable material other than plastic.

Still further changes and modifications are possible without departing from the spirit and scope of the invention which is delimited solely by the appended claims.

What is claimed is:

1. A recoil-type starter for an internal combustion engine comprising: a drum; a starting wire wound around the drum, said drum being disposed in the vicinity of a driven member connected to said engine; a starting pawl pivotally carried by said drum at a peripheral portion of the latter, said starting pawl being adapted to be pivoted to project radially outwardly of said drum at the time of starting into engagement with a cooperative projection formed on said driven member so as to impart a starting inertia to said engine through said driven member, and a stop formed on said drum unitarily therewith, and adapted for abutting over a substantial surface-to-surface area of contact said starting pawl at a portion close to the outer end of the latter at which it engages said cooperative projection, from the radially outer side of said drum, thereby to limit the outward pivotal movement of said starting pawl, said pawl projecting laterally beyond said stop whereby to engage said cooperative projection.

2. A recoil-type starter as claimed in claim 1, wherein said starting pawl is made of plastic having a large impact strength.

3. A recoil-type starter as claimed in claim 1, wherein said driven member is a fly-wheel connected to said engine.

4. A recoil-type starter as claimed in claim 1, further comprising means for causing the radially outward pivotal movement of said starting pawl when said drum is rotated.

5. A recoil-type starter as claimed in claim 4, wherein said last-named means is constituted by a friction wire resiliently connected to said starting pawl and slidably but frictionally received by a friction groove formed on the periphery of a stationary shaft.

6. A recoil-type starter for an internal combustion engine comprising: a drum; a boss formed on said drum; a starting wire wound around the drum, said drum being disposed in the vicinity of a driven member connected to said engine; a starting pawl pivotally carried by said drum at a peripheral portion of the latter, said starting pawl being adapted to be pivoted to project radially outwardly of said drum at the time of starting into engagement with a cooperative projection formed on said driven member so as to impart a starting inertia to said engine through said driven member; a stop formed on said drum unitarily therewith, and adapted for abutting said starting pawl at a portion close to the outer end of the latter at which it engages said cooperative projection, from the radially outer side of said drum, thereby to limit the outward pivotal movement of said starting pawl; and a step formed on said starting pawl and adapted to contact said boss when said starting pawl is engaged by said cooperative projection.

7. A recoil-type starter as claimed in claim 6, wherein said step has an arcuate shape for closely fitting to and around the periphery of said boss.

8. A recoil-type starter as claimed in claim 6, wherein said starting pawl is rotatably supported by a shaft received by a bore formed in said starting pawl, the gap between said shaft and the wall of said bore being larger than that between said step and said boss, thereby to ensure close contact of said step and said boss.

* * * * *